US008811839B2

(12) United States Patent
Furukawa

(10) Patent No.: US 8,811,839 B2
(45) Date of Patent: Aug. 19, 2014

(54) TONER RECOVERY DEVICE, IMAGE FORMING APPARATUS, NON-TRANSITORY READABLE MEDIUM, AND TONER STATE DETERMINING METHOD

(75) Inventor: Shigehiro Furukawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 13/456,807

(22) Filed: Apr. 26, 2012

(65) Prior Publication Data

US 2013/0129366 A1 May 23, 2013

(30) Foreign Application Priority Data

Nov. 18, 2011 (JP) ..... 2011-252433

(51) Int. Cl.
*G03G 21/00* (2006.01)

(52) U.S. Cl.
USPC ..... 399/34; 399/358

(58) Field of Classification Search
CPC ..... G03G 15/0848; G03G 15/0887; G03G 21/10; G03G 21/105
USPC ..... 399/34, 35, 358
See application file for complete search history.

(56) References Cited

U.S. PATENT DOCUMENTS 4,940,850 A * 7/1990 Satake ..... 209/580

FOREIGN PATENT DOCUMENTS

| | | | | |
|---|---|---|---|---|
| JP | 61169422 | A | * | 7/1986 |
| JP | 2000185824 | A | * | 7/2000 |
| JP | 2006047096 | A | * | 2/2006 |
| JP | A-2006-106590 | | | 4/2006 |
| JP | 2008268447 | A | * | 11/2008 |
| JP | 2009236383 | A | * | 10/2009 |
| JP | A-2010-122537 | | | 6/2010 |

* cited by examiner

*Primary Examiner* — Robert Beatty
(74) *Attorney, Agent, or Firm* — Oliff PLC

(57) ABSTRACT

Provided is a toner recovery device including a toner recovery path, a vibration exciter that applies vibration to the toner recovery path, a detector that detects vibration of the toner recovery path, a determining unit that determines whether characteristics based on the vibration detected by the detector have reached predetermined reference vibration characteristics, and an output unit that outputs the result of the determination by the determining unit.

7 Claims, 12 Drawing Sheets

TONER RECOVERY DEVICE, IMAGE FORMING APPARATUS, NON-TRANSITORY READABLE MEDIUM, AND TONER STATE DETERMINING METHOD

CROSS-REFERENCE TO RELATED APPLICATIONS

This application is based on and claims priority under 35 USC 119 from Japanese Patent Application No. 2011-252433 filed Nov. 18, 2011.

BACKGROUND (i) Technical Field

The present invention relates to a toner recovery device having a toner state detecting function, an image forming apparatus, a non-transitory computer readable medium storing a program for realizing a toner state detecting function in a computer of the image forming apparatus, and a toner state determining method.

(ii) Related Art

An image forming apparatus is an apparatus, such as a copier, a facsimile, a printer, or a multifunctional machine having these functions, which forms an image on a recording material such as paper with toner.

In such an image forming apparatus, the particle size of toner is decreasing with a demand for increasing the resolution of a formed image.

Moreover, such an image forming apparatus includes a toner recovery device that recovers through, a toner recovery path, toner which becomes unnecessary for image formation.

SUMMARY

According to an aspect of the present invention, there is provided a toner recovery device including: a toner recovery path; a vibration exciter that applies vibration to the toner recovery path; a detector that detects vibration of the toner recovery path; a determining unit that determines whether characteristics based on the vibration detected by the detector have reached predetermined reference vibration characteristics; and an output unit that outputs the result of the determination by the determining unit.

BRIEF DESCRIPTION OF THE DRAWINGS

Exemplary embodiments of the present invention will be described in detail based on the following figures, wherein.

DETAILED DESCRIPTION

First, an example of an image forming apparatus that embodies the present invention will be described.

Figure 3:
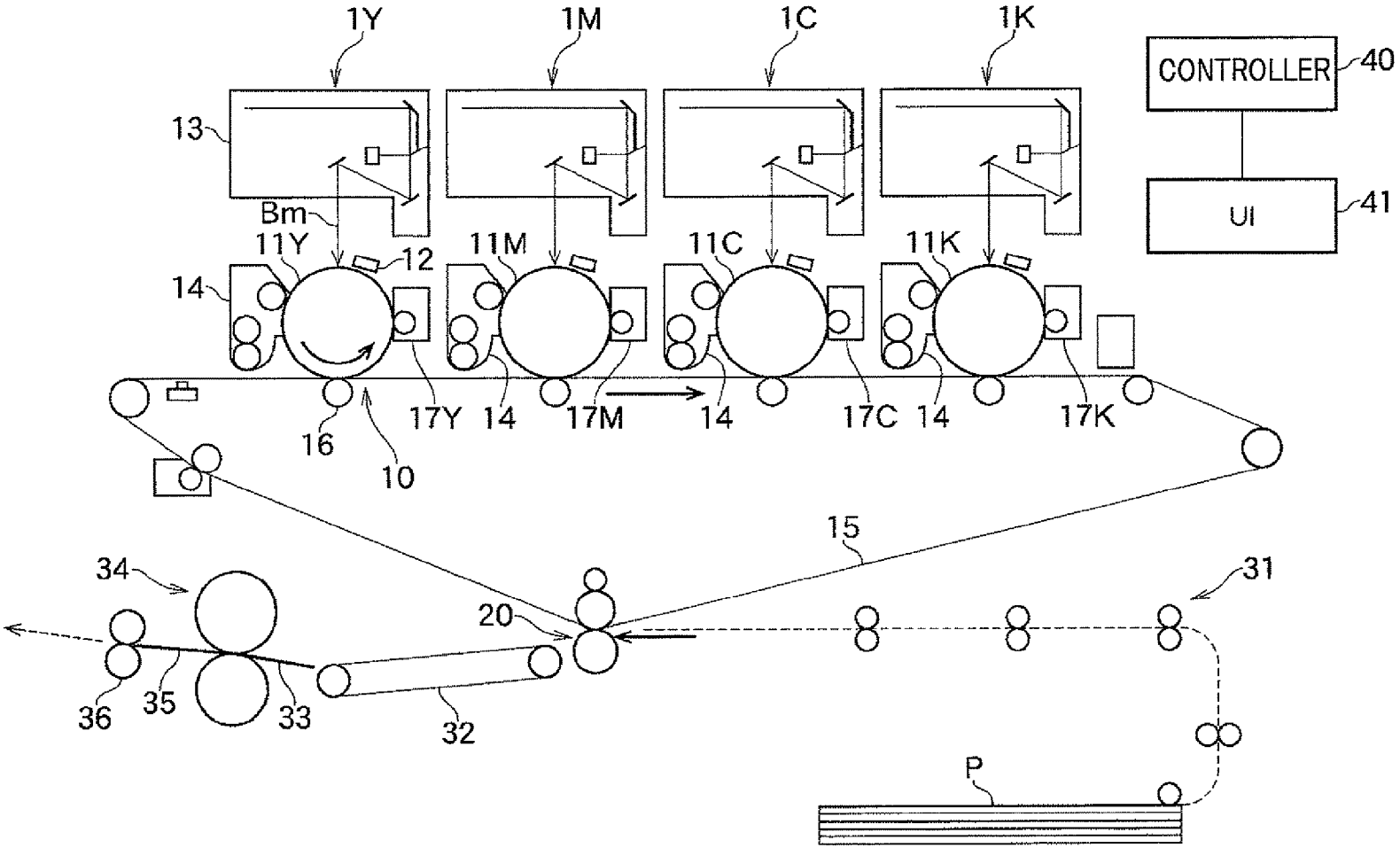
FIG. 3 is a configuration diagram of an image forming unit of the image forming apparatus according to the exemplary embodiment of the present invention.

FIG. 3 illustrates the structure of an image forming unit of the image forming apparatus according to this exemplary embodiment.

The image forming apparatus is an intermediate transfer-type (commonly called a tandem-type) image forming apparatus. Representative function units of the image forming apparatus include plural image forming units 1Y, 1M, 1C, and 1K in which toner images of respective color components are formed by an electrophotographic method, a primary transfer unit 10 that sequentially transfers (primarily transfers) the toner images of respective color components formed by the respective image forming units 1Y, 1M, 1C, and 1K to an intermediate transfer belt 15, a secondary transfer unit 20 that collectively transfers (secondarily transfers) superimposed toner images transferred on the intermediate transfer belt 15 on paper P (an example of a recording material), and a fixing unit 34 that fixes the secondarily transferred image onto the paper P.

Moreover, the image forming apparatus of this exemplary embodiment includes a controller 40 that controls the operation of each unit and a user interface (UI) 41 for presenting information to a user and receiving instructions from the user.

The image forming units 1Y, 1M, 1C, and 1K each have photoconductor drums 11 (11Y, 11M, 11C, and 11K) rotating in the direction indicated by the arrow A. Various electrophotographic devices are sequentially arranged around the photoconductor drum 11. The devices include a charger 12 that charges the photoconductor drum 11, an exposing unit 13 that irradiates the photoconductor drum 11 with an exposure beam Bm to write an electrostatic latent image, a developing unit 14 that accommodates toner of respective color components and visualizes the electrostatic latent image on the photoconductor drum 11 with toner to form a toner image, a primary transfer roll 16 that transfers the toner images of respective color components formed on the photoconductor drum 11 to the intermediate transfer belt 15 at the primary transfer unit 10 in a superimposed manner, and a drum cleaner 17 (17Y, 17M, 17C, and 17K) that removes residual toner on the photoconductor drum 11.

These image forming units 1Y, 1M, 1C, and 1K are disposed approximately in a linear form in the order of yellow (Y), magenta (M), cyan (C), and black (K) from the upstream side of the intermediate transfer belt 15 and are configured to be moved toward and away from the intermediate transfer belt 15.

Moreover, a paper transporting system of the image forming apparatus includes a paper feeding mechanism unit 31 that performs a paper feeding operation of unloading paper P from a sheet accommodating unit and feeding the paper P to the secondary transfer unit 20, a transporting belt 32 that transports the paper P having passed through the secondary transfer unit 20 toward the fixing unit 34, a fixing entry guide 33 that guides the paper P to the entry of the fixing unit 34, a discharge guide 35 that guides the paper P discharged from the fixing unit 34, and a discharge roll 36 that discharges the paper P guided by the discharge guide 35 to the outside of the image forming apparatus.

That is, the paper P fed from the paper accommodating unit to the secondary transfer unit 20 by the paper feeding mechanism unit 31 is transported to the transporting belt 32 in a state where the paper P is separated from the intermediate transfer belt 15 after the toner image on the intermediate transfer belt 15 is electrostatically transferred to the paper P at the secondary transfer unit 20. Moreover, the paper P is transported up to the fixing unit 34 via the fixing entry guide 33 by the transporting belt 32 in synchronism with the operating speed of the fixing unit 34. An unfixed toner image on the paper P transported to the fixing unit 34 is fixed to the paper P by being subjected to a fixing process in which the fixing unit 34 applies heat and pressure to the unfixed toner image. After that, the paper P on which a fixed image is formed is transported to a discharged paper accommodating unit (not shown) provided outside the image forming apparatus via the paper discharge guide 35 and the discharge roll 36.

Here, the respective drum cleaners 17Y, 17M, 17C, and 17K remove unnecessary residual toner from the photoconductor drum 11, and the removed toner is recovered by a toner recovery device provided in the image forming apparatus.

Figure 4:
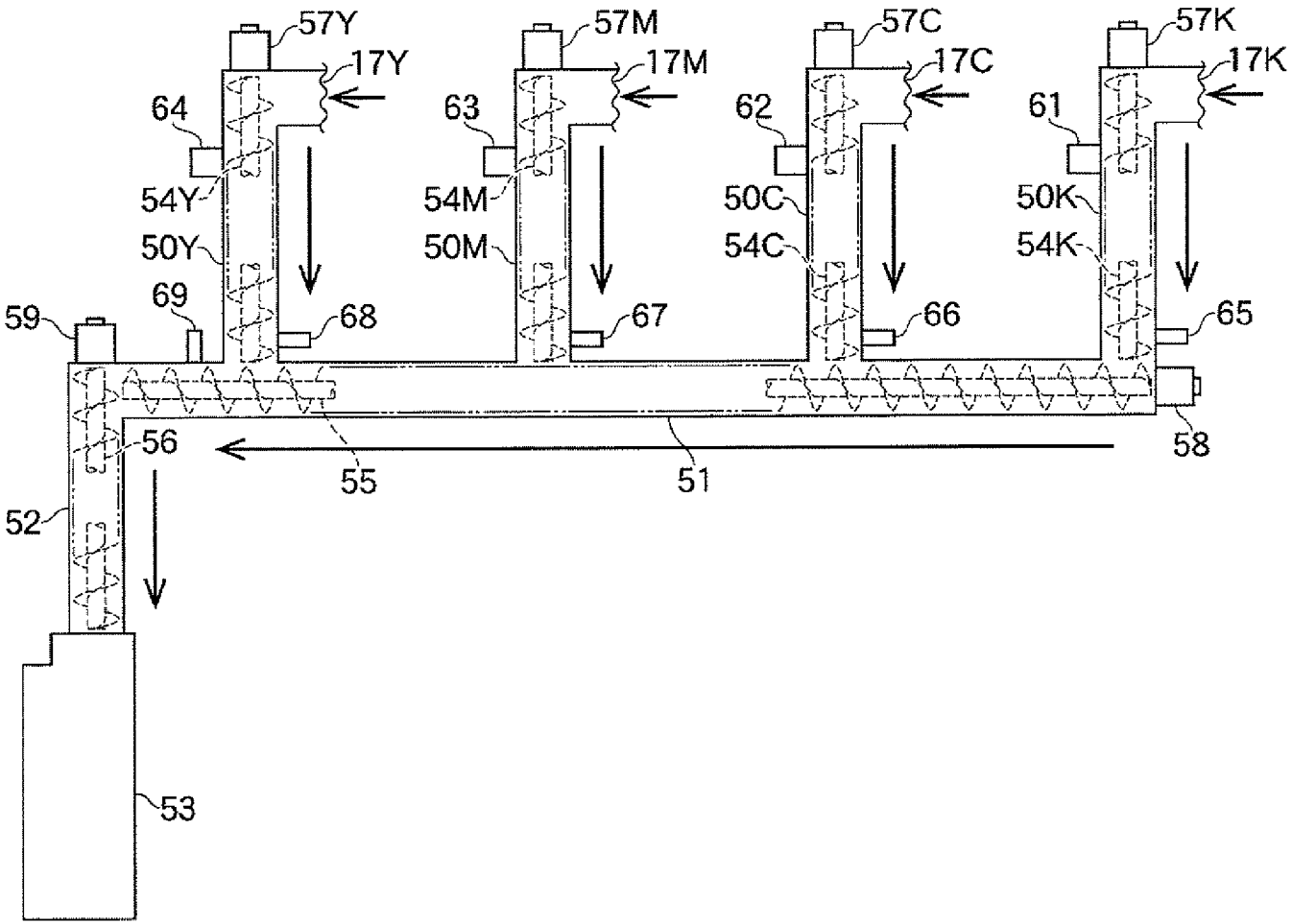
FIG. 4 is a configuration diagram of a toner recovery unit of the image forming apparatus according to the exemplary embodiment of the present invention.
Figure 5:
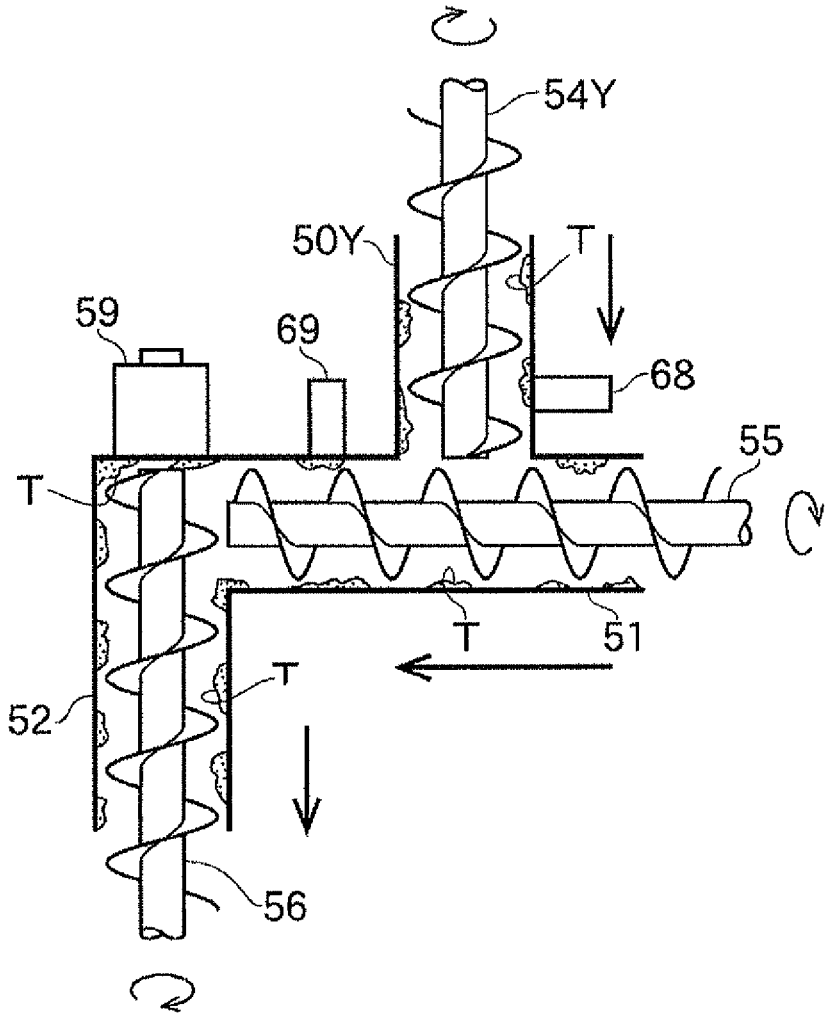
FIG. 5 is an enlarged view of a part of FIG. 4.

The image forming apparatus according to an exemplary embodiment of the present invention, shown in FIG. 3 is provided with a toner recovery device shown in FIGS. 4 and 5.

The toner recovery device includes cylindrical toner recovery paths 50Y, 50M, 50C, and 50K installed in the housing of the image forming apparatus so as to extend in the vertical direction with respective upper ends being connected to the drum cleaners 17Y, 17M, 17C, and 17K, respectively, cylindrical toner recovery path 51 connected to the lower ends of the toner recovery paths 50Y, 50M, 50C, and 50K so as to extend in the horizontal direction, a cylindrical toner recovery path 52 connected to the distal end of the toner recovery path 51 so as to extend in the vertical direction, and a toner recovery bottle 53 connected to the lower end of the toner recovery path 52.

Thus, a toner recovery path extending from the respective drum cleaners 17Y, 17M, 17C, and 17K to the toner recovery bottle 53 is made up of the toner recovery paths 50Y, 50M, 50C, and 50K, the toner recovery path 51, and the toner recovery path 52.

Augers 54Y, 54M, 54C, 54K, 55, and 56 that form a helical lower flange as shown in detail in FIG. 5 are accommodated in the respective toner recovery paths 50Y, 50M, 50C, 50K, 51, and 52 so as to be rotatable about their axes, and motors 57Y, 57M, 57C, 57K, 58, and 59 are formed at the end portions of the respective augers 54Y, 54M, 54C, 54K, 55, and 56.

Therefore, as shown by arrows in FIGS. 4 and 5, when the motors 57Y, 57M, 57C, 57K, 58, and 59 are operated under the control of the controller 40, the augers are rotated in the respective toner recovery paths. In this way, toner is transported by the lower flanges of the augers within the respective toner recovery paths, and the toner recovered from the respective drum cleaners 17Y, 17M, 17C, and 17K is transported to the toner recovery bottle 53 through the toner recovery paths.

Although a cylindrical toner recovery path is used since toner is transported using an auger, the toner recovery path may not be cylindrical depending on the structure of a toner transporting unit, and the shape of the toner recovery path and the toner transporting unit are not particularly limited as long as recovered toner is transported without any problem.

Here, since toner is fine particle, toner T to be recovered may adhere to the inner walls of the toner recovery path and accumulate as shown in FIG. 5. Accumulation of toner in the toner recovery path becomes remarkable since deterioration of the fluidity of fine toner appears remarkable as toner becomes finer.

Due to arrangement relation with other devices of the image forming apparatus, the toner recovery path is often formed to be bent as shown in FIG. 4. In such a bent portion of the toner recovery path, as shown in FIG. 5, the toner T to be recovered is more likely to adhere to the inner walls of the toner recovery path or accumulate while forming a space where toner is not transported.

When such accumulation progresses, toner stagnates in the toner recovery path to cause clogging of the toner to be recovered. As a result, the image forming apparatus may not operate properly.

Therefore, although periodic maintenance needs to be performed in order to prevent or eliminate toner clogging, there is a problem in that it is difficult to detect the toner state in the toner recovery path and to perform maintenance at an appropriate time.

Therefore, in an exemplary embodiment of the present invention, as shown in FIGS. 4 and 5, vibration exciters 61, 62, 63, and 64 are provided in the upper end portions of the respective toner recovery paths 50Y, 50M, 50C, and 50K. Moreover, vibration detectors 65, 66, 67, and 68 are provided in the lower end portions of the respective toner recovery paths 50Y, 50M, 50C, and 50K. Furthermore, a vibration detector 69 is provided near a bent portion of the toner recovery path 51 connected to the toner recovery path 52. In this way, vibration generated by the vibration exciters 61, 62, 63, and 64 propagates through the toner recovery paths and is detected by the respective vibration detectors 65, 66, 67, 68, and 69.

In order to broaden a vibration detection range, the vibration exciter and the vibration detector may be respectively disposed to be located as closer as possible to the upstream and downstream sides of the toner recovery path.

When a series of toner recovery paths are formed by connecting plural toner recovery paths as described above, in order to suppress the influence on vibration propagation, of bonding portions (for example, joint portions of pipes that form the toner recovery paths) of the respective toner recovery paths, the vibration exciter and the vibration detector may be provided in units of segments segmented by the bonding portions of the series of toner recovery paths.

An existing vibration generator such as an electromagnetic solenoid may be appropriately employed as the vibration exciters 61, 62, 63, and 64. As in this exemplary embodiment, a vibration generator capable of generating vibration of a certain amplitude and frequency and allowing accurate On/Off control may be used.

An existing vibration sensor, for example, may be appropriately employed as the vibration detectors 65, 66, 67, 68, and 69.

Moreover, the toner recovery path may be formed of material having good vibration transmittance such as metal or hard plastic.

Figure 1:
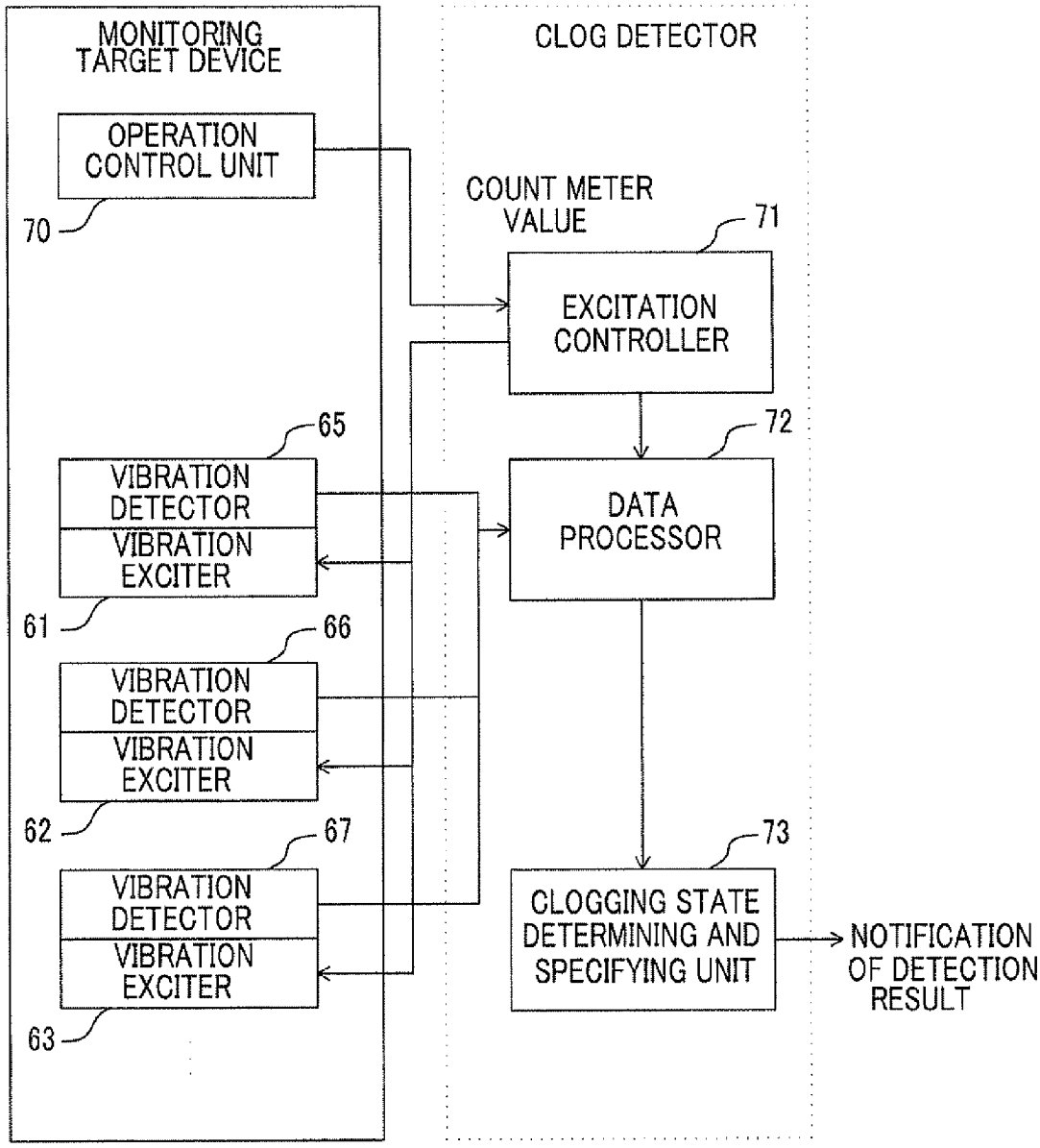
FIG. 1 is a functional configuration diagram of a main part of an image forming apparatus according to an exemplary embodiment of the present invention.

The image forming apparatus of this exemplary embodiment has a toner state determining function having the configuration as shown in FIG. 1. This determining function determines the state such as degree of accumulation of the toner in the toner recovery path based on the vibration characteristics detected by the respective vibration detectors 65, 66, 67, 68, and 69.

Only the vibration detectors 65, 66, and 67 and the vibration exciters 61, 62, and 63 are illustrated representatively in FIG. 1, and the other vibration detectors 68 and 69 and the vibration exciter 64 shown in FIG. 4 are not illustrated for the sake of simplicity. Moreover, in FIG. 1, the image forming apparatus having the toner recovery device that transports toner to the toner recovery bottle 53 through the toner recovery path is illustrated as a monitoring target device.

That is, a configuration related to the toner state determining function of the image forming apparatus of this exemplary embodiment includes an operation control unit 70 that outputs information (count meter value) representing an operation state of the image forming apparatus, an excitation controller 71 that drives the vibration exciters 61, 62, 63, and 64 in accordance with the count meter value to generate vibration, a data processor 72 that specifies vibration characteristics based on the vibration detected by the vibration detectors 65, 66, 67, 68, and 69, and a clogging state determining and specifying unit 73 that determines whether or not the vibration characteristics specified by the data processor 72 have reached predetermined reference vibration characteristics and outputs the determination result (notification of the determination result).

Here, in this exemplary embodiment, although the number of pages of an image formed and output by the image forming apparatus is used as the count meter value, various types of information representing a change in the toner state over time such as an accumulated operation time of the image forming apparatus may be used.

Moreover, in this exemplary embodiment, plural vibration detectors are provided at different locations of the toner recovery path, and based on the vibration detected by the respective vibration detectors, the clogging state determining and specifying unit 73 specifies an area in the toner recovery path corresponding to the location of the vibration detector, determines the toner state, and outputs a notification of the determination result. However, the clogging state determining and specifying unit 73 may output the notification of the determination result without specifying the area. Moreover, the vibration detector may be provided at one appropriate location of the toner recovery path and may determine the toner state in the toner recovery path and output a notification of the determination result. That is, the number of vibration detectors and the installed position thereof are optional. Moreover, the number of vibration exciters and the installed position thereof are optional if the vibration exciter applies necessary vibration to a target toner recovery path.

Figure 2:
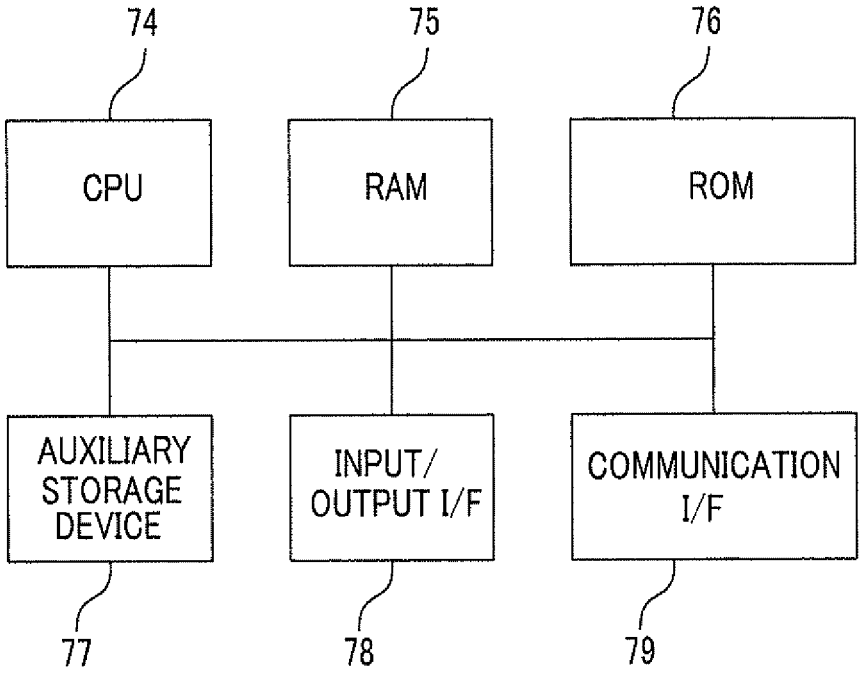
FIG. 2 is a computer hardware configuration diagram of a main part of the image forming apparatus according to the exemplary embodiment of the present invention.

As shown in FIG. 2, the image forming apparatus of this exemplary embodiment includes computer hardware which includes a CPU 74, a RAM 75, a ROM 76, an auxiliary storage device 77, an input/output I/F 78, and a communication I/F 79. A toner state determining program according to this exemplary embodiment is executed by the computer hardware, whereby the operation control unit 70, the excitation controller 71, the data processor 72, and the clogging state determining and specifying unit 73 are configured, and these respective functional units perform the processes according to this exemplary embodiment.

In this exemplary embodiment, the toner recovery path having the auger, the vibration exciter, the vibration detector, the operation control unit 70, the excitation controller 71, the data processor 72, and the clogging state determining and specifying unit 73 form the toner recovery device having a toner state determining function provided to the image forming apparatus. Next, an operation example of the toner recovery device will be described in detail.

The vibration applied from the vibration exciter propagates through the toner recovery path and is detected by the vibration detector. Since the detected vibration changes with the degree of stagnation of the toner in the toner recovery path, the degree of stagnation of the toner in the toner recovery path (that is, the state where toner stagnates so that clogging occurs) is determined.

When clogging of toner occurs in a certain location of the toner recovery path, and vibration is applied to a portion near the clogging occurred location, a vibration value changes as compared to a state where clogging is not present. Vibration detectors are provided at plural locations of the toner recovery path to measure a vibration value detected at each location and extract characteristic vibration properties (vibration characteristics) during occurrence of clogging. The extracted vibration characteristics are compared with reference vibration characteristics set in advance to determine the occurrence of clogging.

Figures 6A, 6B:
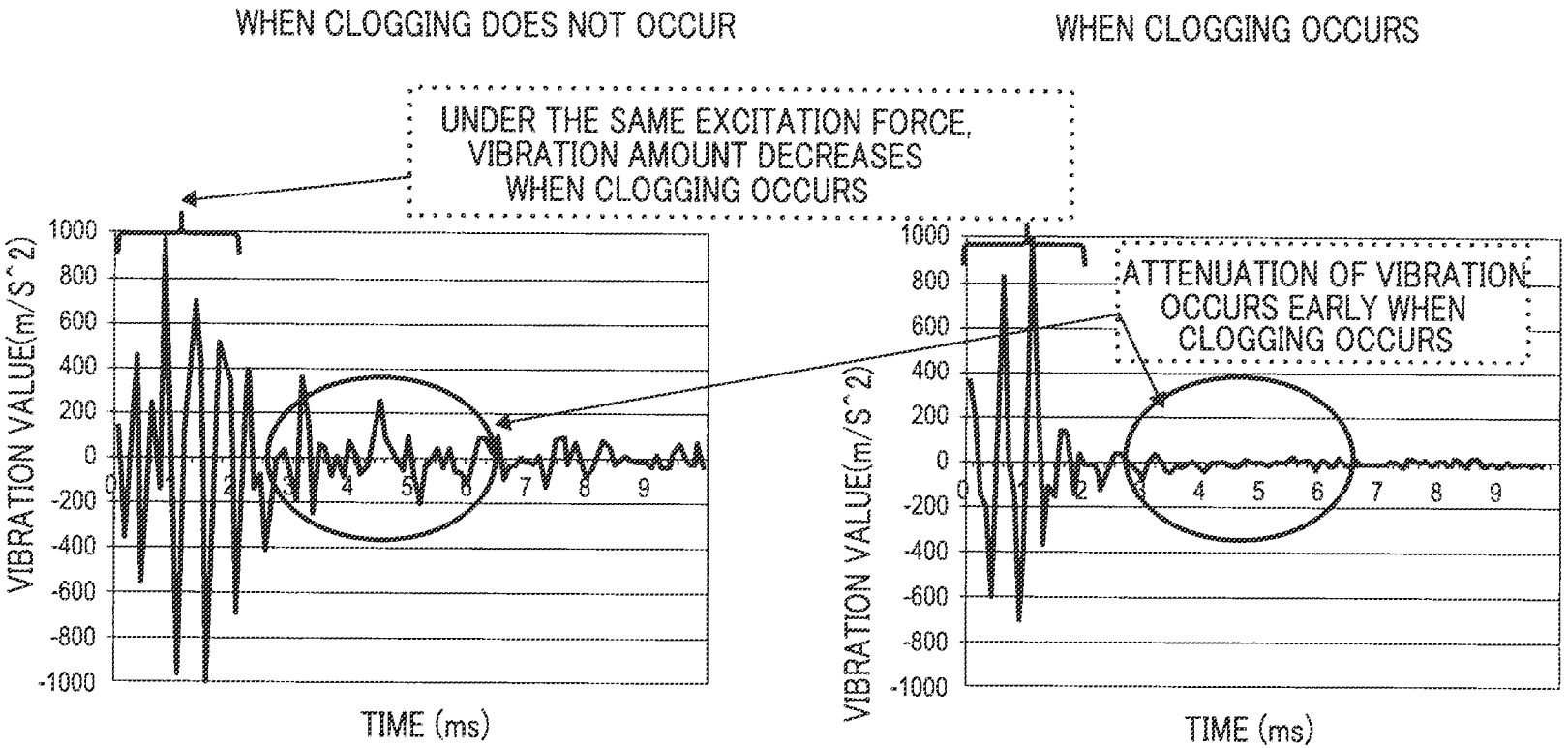
FIGS. 6A and 6B are diagrams for explaining vibration characteristics according to the exemplary embodiment of the present invention.

When vibration is applied from the vibration exciter to the toner recovery path, and the vibration having propagated through the toner recovery path is detected by the vibration detector, the waveform of the detected vibration is different from state (FIG. 6A) where toner clogging does not occur to state (FIG. 6B) where toner clogging occurs as shown in FIGS. 6A and 6B.

For example, as shown in FIGS. 6A and 6B, attenuation of the vibration waveform in a state where toner stagnates in the toner recovery path occurs early as compared to a state where toner does not stagnate. The tendency is remarkable as the degree of stagnation increases so that toner clogging occurs. This is attributable to the fact that the density of stagnated toner increases.

Moreover, for example, as shown in FIGS. 6A and 6B, a vibration amount immediately after vibration is applied to the toner recovery path in a state where toner stagnates in the toner recovery path decreases as compared to a case where toner does not stagnate. The tendency is remarkable as the degree of stagnation increases so that toner clogging occurs. This is attributable to the fact that the total amount of stagnated toner increases.

Moreover, the vibration frequency immediately after vibration is applied to the toner recovery path increases as the density of the stagnated toner increases. Thus, it is possible to detect the state of toner stagnation using the vibration frequency.

In this exemplary embodiment, the data processor 72 specifies at least one of the vibration characteristics including attenuation of a vibration waveform, a decrease of vibration amount, and frequency based on the vibration detected by the vibration detector. The clogging state determining and specifying unit 73 compares the specified vibration characteristics with reference vibration characteristics which are characteristics of the same kind to thereby determine whether the toner is in a predetermined state such as a clogging state. That is, the clogging state determining and specifying unit 73 determines the degree of toner accumulation (and thus the clogging state of toner) using the characteristics based on the detected vibration.

Here, as the characteristics based on the vibration detected by the vibration detector, various vibration characteristics in addition to the above examples may be used as long as the characteristics change with the degree of accumulation of toner in the toner recovery path.

Moreover, as characteristics based on the vibration detected by the vibration detector, characteristics obtained by the data processor 72 applying an arithmetic operation to the detected vibration value may be used.

Figure 7:
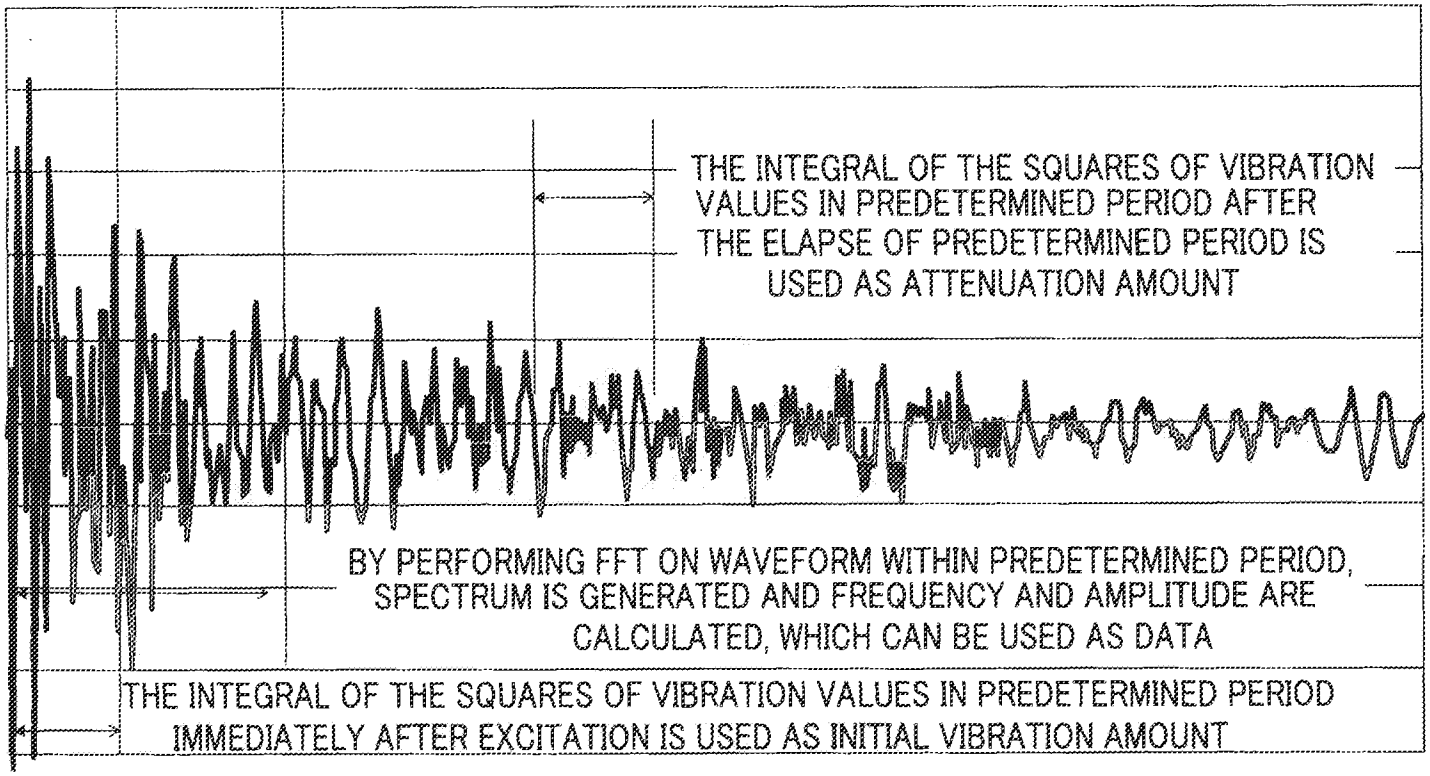
FIG. 7 is a diagram for explaining vibration characteristics according to the exemplary embodiment of the present invention.

For example, as shown in FIG. 7, the integral of the squares of vibration values in a predetermined period after the elapse of a predetermined period from the time when vibration is applied as an attenuation amount may be used as the characteristics based on vibration. Alternatively, by performing an FFT operation on a waveform within a predetermined period immediately after vibration is applied, a spectrum may be generated, and the frequency and amplitude may be calculated and used as the characteristics based on vibration. Alternatively, the integral of the squares of vibration values in a predetermined period immediately after vibration is applied as an initial vibration amount may be used as the characteristics based on vibration.

The reference vibration characteristics used as the determination criterion are obtained in advance by an experiment or the like based on the vibration detected by the vibration detector in a toner state (for example, a toner clogging state) to be determined of the toner recovery path, and the characteristics are set in the clogging state determining and specifying unit 73.

The reference characteristics are vibration characteristics of the same kind corresponding to the vibration characteristics specified based on the detected vibration, and as in the case of this exemplary embodiment, when the toner state is determined for each area of plural vibration detectors, the reference characteristics are set for each vibration detected by the respective vibration detectors.

Figure 8A:
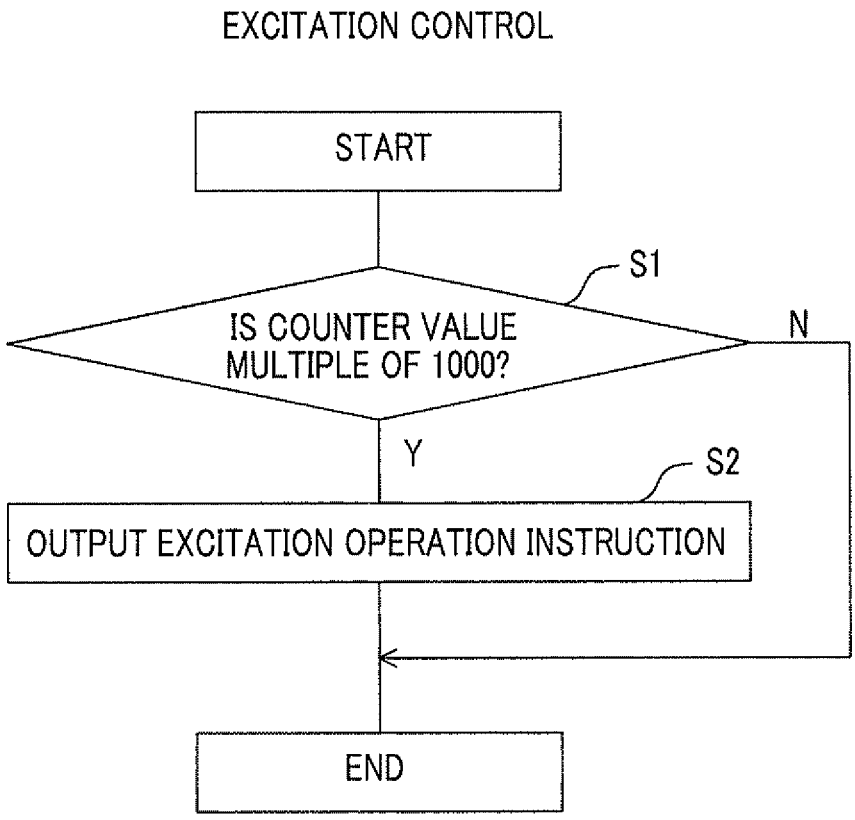
FIGS. 8A and 8E are diagrams for explaining processes according to the exemplary embodiment of the present invention.
Figure 8B:
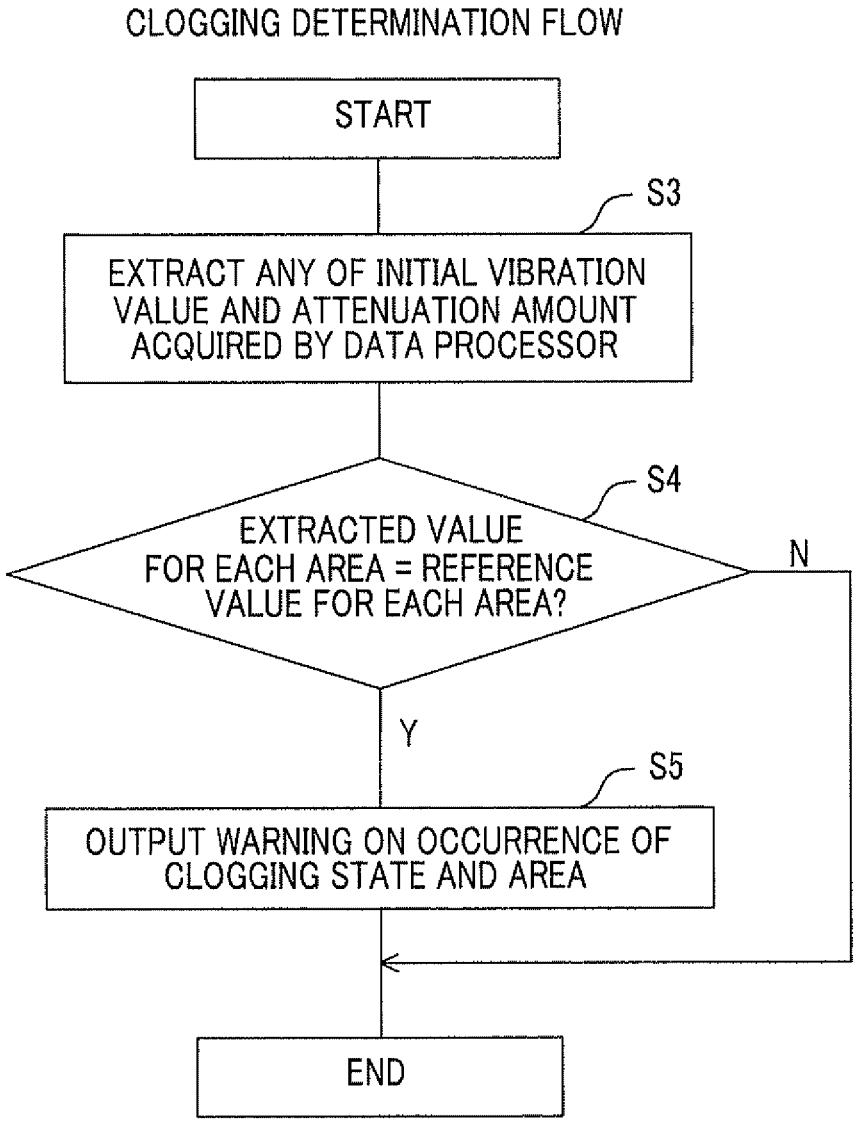

FIGS. 8A and 8B show a toner state determining process according to this exemplary embodiment.

The toner state determining process according to this exemplary embodiment includes an excitation control process (FIG. 8A) of driving the vibration exciters 61, 62, 63, and 64 and a determining process (FIG. 8B) of determining the toner state (in this example, the toner clogging state) based on the characteristics based on the vibration detected by the vibration detectors 65, 66, 67, 68, and 69.

First, the excitation controller 71 determines the count meter value input from the operation control unit 70 is a multiple of 1000 (step S1). When the count meter value is a multiple of 1000, the excitation controller 71 outputs an excitation operation instruction to drive the vibration exciters 61, 62, 63, and 64 (step S2).

That is, in this exemplary embodiment, whenever the image forming apparatus is operated to an extent such that the number of pages of an image formed by the image forming apparatus reaches 1000 (that is, the amount of toner recovered reaches a predetermined amount), the vibration exciter applies vibration to the toner recovery path. The count value when excitation is performed is optional.

When the vibration exciter applies vibration to the toner recovery path, the vibration propagates through the toner recovery path and is detected by the vibration detectors 65, 66, 67, 68, and 69. The data processor 72 specifies (extracts) vibration characteristics (in this example, at least one of an initial vibration value or a vibration attenuation amount) for each area based on the detected vibration (step S3).

Moreover, the clogging state determining and specifying unit 73 determines whether the specified (extracted) vibration characteristics for each area have reached reference vibration characteristics for each area (step S4) and outputs the determination result when the vibration characteristics have reached the reference vibration characteristics (step S5).

In addition, vibration from other devices of the image forming apparatus may be input to the toner recovery path as noise and detected by the vibration detector. In such a case, vibration characteristics specified by taking noise into consideration in advance may be used. Alternatively, a method of removing noise from vibration detected by a filter circuit or the like may be employed.

When the characteristics based on the vibration detected from the toner recovery path have reached the reference vibration characteristics, it is determined that a predetermined toner state (in this example, a toner clogging state) is created, and the determination result is output.

In this exemplary embodiment, the determination is performed for each installed area of the vibration detector and the determination result is output for each installed area of the vibration detector. For example, the toner state for each area of the toner recovery path, the area where toner clogging occurs, and the like are output as a warning by the input/output I/F 78 and the UI 41 in such a manner that they are understood by the user of the image forming apparatus. Alternatively, the toner state, the area, and the like are notified as a warning to the administrator of the image forming apparatus by the communication I/F 79. In this way, the user and the administrator may understand the occurrence of toner clogging and perform necessary maintenance.

In addition, it may be easily understood that it is possible to determine a toner accumulation state before toner clogging occurs by appropriately setting the reference vibration characteristics.

Moreover, it may be easily understood that the number of vibration exciters and vibration detectors and the installed positions are appropriately set as necessary.

Figure 9:
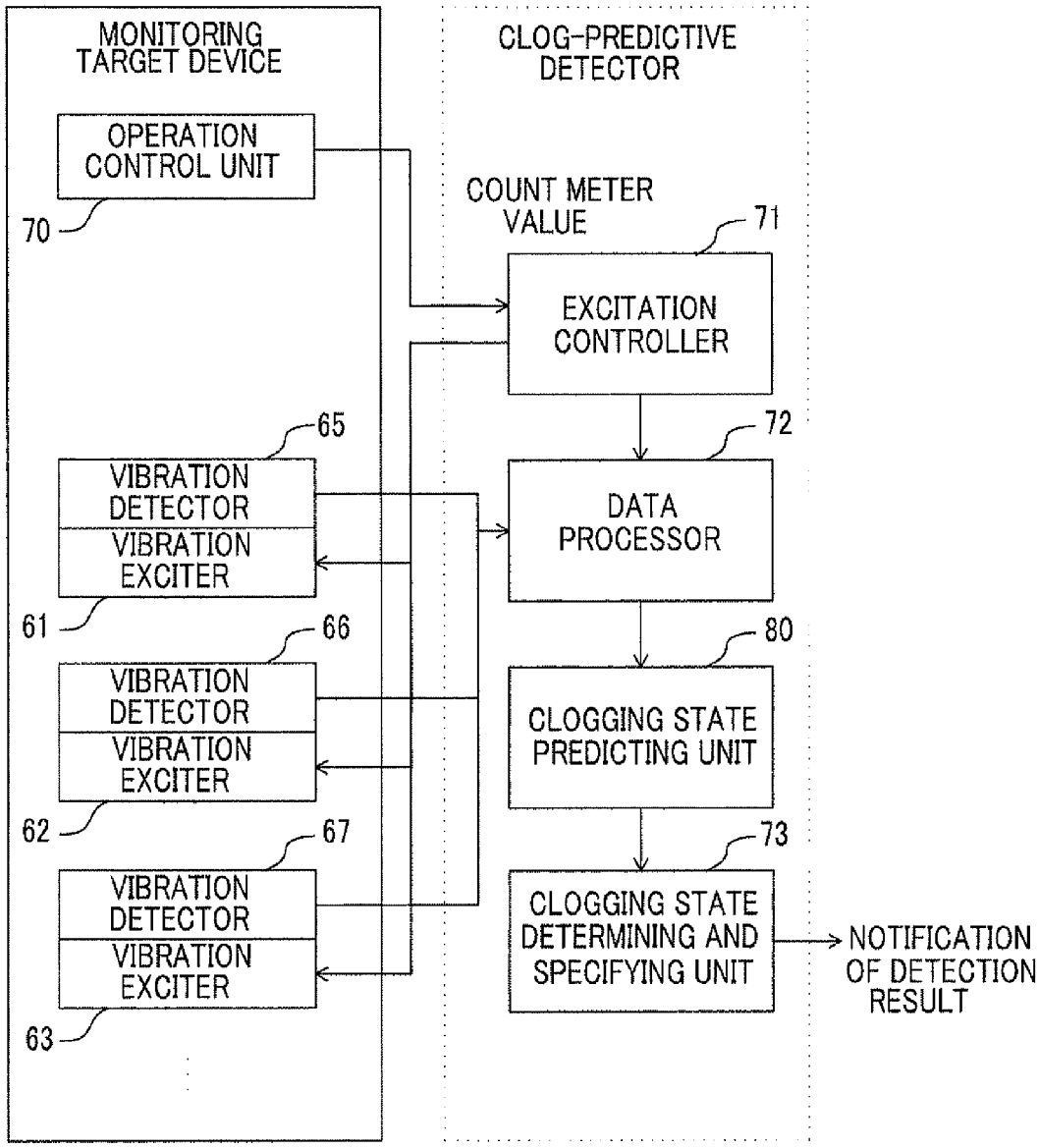
FIG. 9 is a functional configuration diagram of a main part of an image forming apparatus according to another exemplary embodiment of the present invention.

FIG. 9 shows another exemplary embodiment according to the present invention.

In this exemplary embodiment, the image forming apparatus determines and outputs indications of a toner clogging state and has a toner state determining function as shown in FIG. 9.

The other configurations related to the toner recovery path, the vibration exciter, the vibration detector are the same as those of the above exemplary embodiment, and in FIG. 9, the same configurations as the above exemplary embodiment are denoted by the same reference numerals.

In this exemplary embodiment, the image forming apparatus includes a clogging state predicting unit 80. The clogging state predicting unit 80 calculates an index value for predicting a toner clogging state using the vibration characteristics specified by the data processor 72 and the count meter value output from the operation control unit 70.

Moreover, in this exemplary embodiment, an index value of the same kind as above is set in advance in the clogging state determining and specifying unit 73 as a reference value.

The index value is calculated, for example, by a prediction formula of "(Count meter value×a1)+(Initial vibration value×a2)+(Vibration attenuation amount×a3)+b". In this exemplary embodiment, the index value is calculated for each area by the respective vibration detectors, and similarly, a reference value for each area is set in the clogging state determining and specifying unit 73.

Here, a1 to a3 are regression coefficients and b is a constant. The regression coefficients and the constant are determined based on measurement data such as a count meter value, an initial vibration value, and a vibration attenuation amount when a toner clogging state is created in advance.

Any one of the initial vibration value and the vibration attenuation amount may be used in calculating the index value, and vibration characteristics other than the initial vibration value and the vibration attenuation amount may be used.

Thus, it may be said that the index value is characteristic based on the vibration detected by the vibration detector, and the reference value is reference vibration characteristic.

Figure 10:
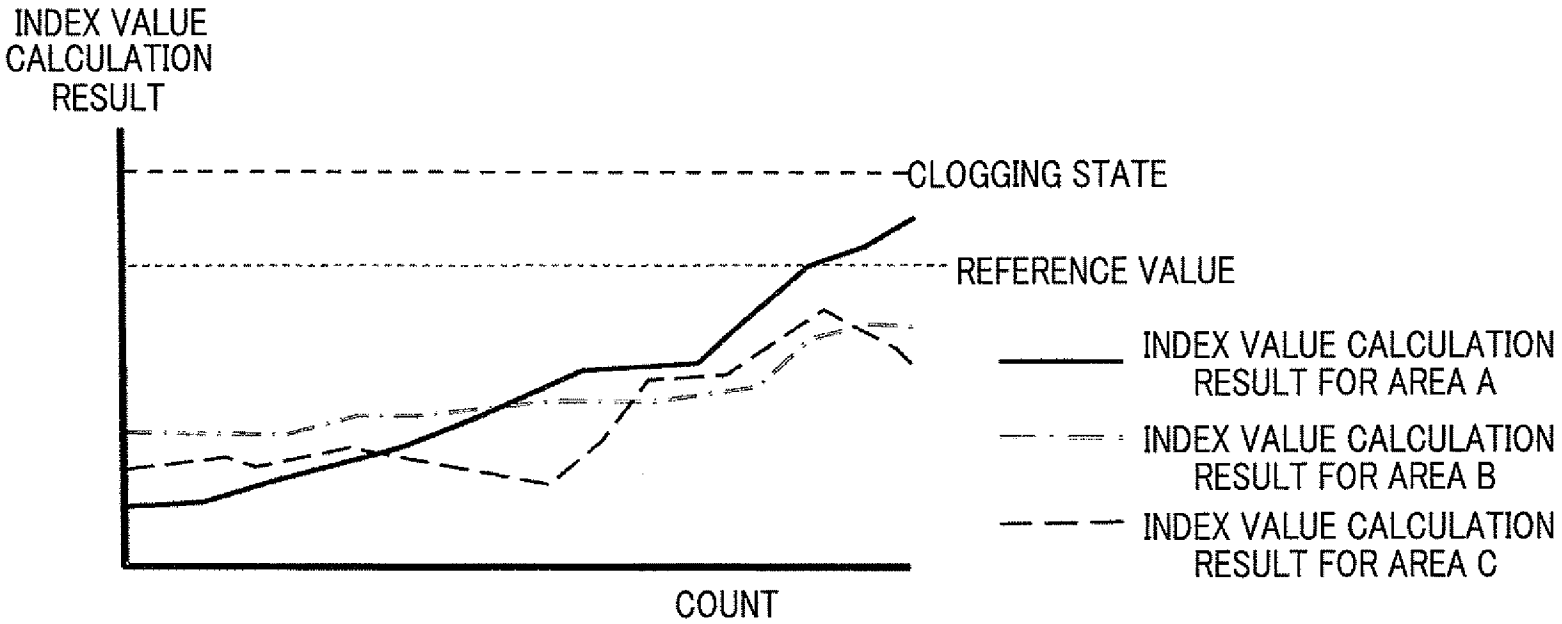
FIG. 10 is a diagram for explaining vibration characteristics according to another exemplary embodiment of the present invention.

Specifically, for example, as shown in FIG. 10, the reference value is set to a value represented by the index value calculated based on the detected vibration before the index value reaches a value in the toner clogging state.

Figure 11:
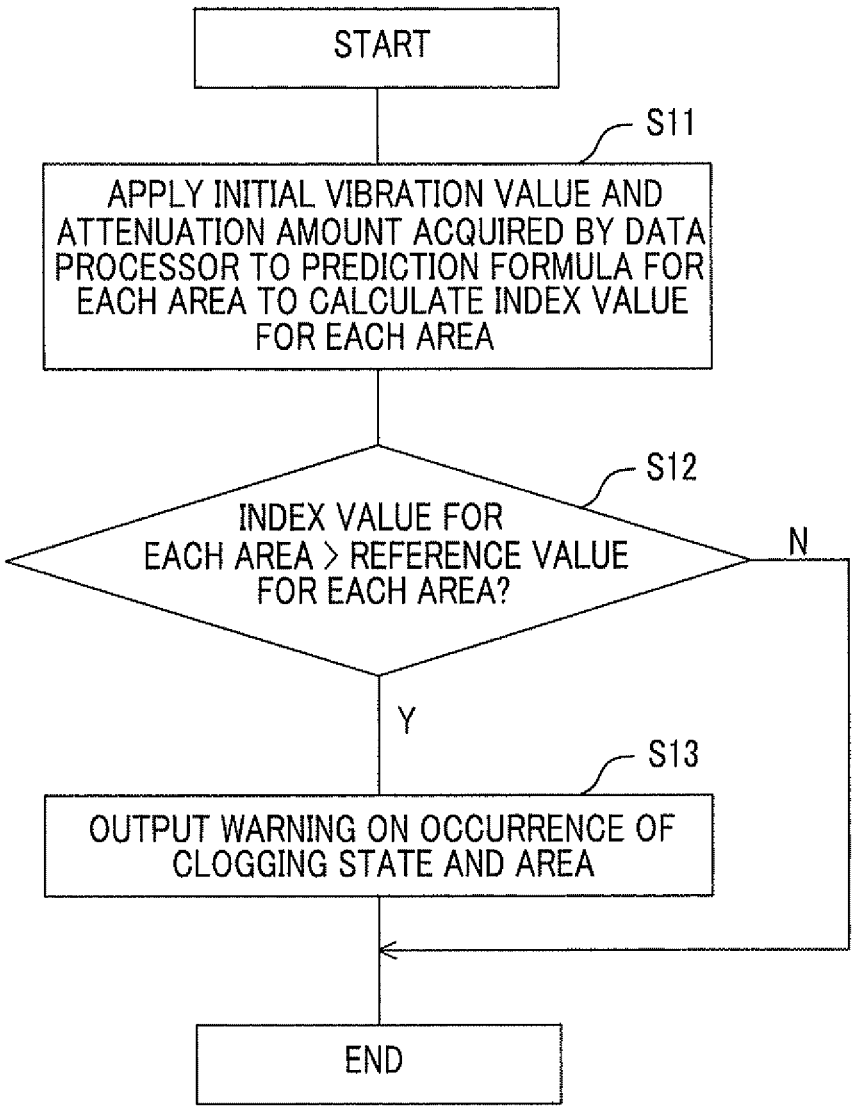
FIG. 11 is a diagram for explaining processes according to another exemplary embodiment of the present invention.

In this exemplary embodiment, the same process as FIG. 8A is performed, and the process shown in FIG. 11 is performed instead of the process shown in FIG. 8B.

First, when vibration is applied to the toner recovery path by the vibration exciter, the vibration propagates through the toner recovery path and is detected by the vibration detectors 65, 66, 67, 68, and 69. The data processor 72 specifies (extracts) vibration characteristics (in this example, an initial vibration value and a vibration attenuation amount) for each area based on the detected vibration. The clogging state predicting unit 80 applies the initial vibration value, the vibration attenuation amount, and the count meter value to the prediction formula to calculate the index value for each area (step S11).

Moreover, the clogging state determining and specifying unit 73 determines whether the calculated index value for each area has reached the reference value for each area (step S12) and outputs the determination result when the index value has become higher than the reference value (step S13).

Thus, as shown in FIG. 10, by setting a predetermined value before a clogging state is created as a reference value with respect to the index value which increases whenever the count meter value increases, the user and the administrator may understand in advance indications representing that a toner clogging state is created from the output of the determination result.

Here, in the two exemplary embodiments described above, although the number of vibration detectors and vibration exciters may be set optionally as necessary, by increasing the kinds of vibration characteristics used for determination, for example, it is possible to decrease the number of vibration detectors and vibration exciters.

In addition, the toner state may be determined without particularly limiting the area using one vibration detector and one vibration exciter.

In the two exemplary embodiments described above, the toner recovery path is excited in accordance with the count value, and the toner state based on excitation is determined during the operation of the image forming apparatus. The toner state may be determined in various ways as follows. For example, when an operation is being performed, the excitation may be held until the operation ends and the exciting operation may be performed after the operation ends. Alternatively, after temporarily holding the operation, the excitation and the determination process may be performed, and then the operation may restart after the excitation and the determination process end.

In addition, the functions related to the determination by the vibration detector and the vibration exciter may always be operated so that the toner state is determined at all times without considering the operation state of the image forming apparatus such as the count value. Moreover, a timer for determination may be provided additionally, and the functions related to the determination by the vibration detector and the vibration exciter may be operated based on a predetermined timer value regardless of the operation state of the image forming apparatus.

Moreover, an image forming apparatus that develops an image with four colors of toner of yellow (Y), magenta (M), cyan (C), and black (K) has been described as an example. The present invention may be applied to an image forming apparatus that develops an image with five colors of toner including transparent toner in addition to the above toners and an image forming apparatus that develops an image with monochrome toner of black (K). That is, the kind of toner, the number of toners, and the format of the image forming apparatus are not particularly limited if they are image forming apparatuses that develop an image with toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner recovery device comprising:

a toner recovery path;

a vibration exciter that applies vibration to the toner recovery path;

a detector that detects vibration of the toner recovery path;

a determining unit that determines whether characteristics based on the vibration detected by the detector have reached predetermined reference vibration characteristics; and an output unit that outputs the result of the determination by the determining unit, wherein the reference vibration characteristics are set in advance as indications representing that toner stagnates in the toner recovery path, wherein the determining unit determines indications that toner stagnates in the toner recovery path by determining whether the characteristics based on the vibration detected by the detector have reached the reference vibration characteristics, wherein the output unit outputs information representing indications that toner stagnates in the toner recovery path as the result of the determination by the determining unit, wherein the detector detects at least one of an initial vibration value and a vibration attenuation amount, and wherein the characteristics based on the vibration are an index value obtained by adding a count value representing the operating state of the image forming apparatus to at least one of the initial vibration value and the vibration attenuation amount.

2. An image forming apparatus comprising:

a vibration exciter that applies vibration to a toner recovery path;

a detector that detects vibration of the toner recovery path;

a determining unit that determines whether characteristics based on the vibration detected by the detector have reached predetermined reference vibration characteristics; and an output unit that outputs the result of the determination by the determining unit, wherein the reference vibration characteristics are set in advance as indications representing that toner stagnates in the toner recovery path, wherein the determining unit determines indications that toner stagnates in the toner recovery path by determining whether the characteristics based on the vibration detected by the detector have reached the reference vibration characteristics, wherein the output unit outputs information representing indications that toner stagnates in the toner recovery path as the result of the determination by the determining unit, wherein the detector detects at least one of an initial vibration value and a vibration attenuation amount, and wherein the characteristics based on the vibration are an index value obtained by adding a count value representing the operating state of the image forming apparatus to at least one of the initial vibration value and the vibration attenuation amount.

3. The image forming apparatus according to claim 2, wherein a plurality of the detectors are provided so as to detect the vibration from a plurality of different locations of the toner recovery path, wherein the determining unit determines whether characteristics based on the vibration detected by the detectors have reached the reference vibration characteristics, and wherein the output unit outputs the results of the determinations for each of the detectors by the determining unit.

4. The image forming apparatus according to claim 2, wherein the reference vibration characteristics are set in advance as representing a state where toner stagnates in the toner recovery path, wherein the determining unit determines the state where toner stagnates in the toner recovery path by determining whether the characteristics based on the vibration detected by the detector have reached the reference vibration characteristics, and wherein the output unit outputs information representing the state where toner stagnates in the toner recovery path as the result of the determination by the determining unit.

5. The image forming apparatus according to claim 3, wherein the reference vibration characteristics are set in advance as representing a state where toner stagnates in the toner recovery path, wherein the determining unit determines the state where toner stagnates in the toner recovery path by determining whether the characteristics based on the vibration detected by the detector have reached the reference vibration characteristics, and wherein the output unit outputs information representing the state where toner stagnates in the toner recovery path as the result of the determination by the determining unit.

6. A non-transitory computer readable medium storing a toner state determining program for causing a computer of an image forming apparatus to execute a process, the process comprising:

comparing characteristics based on vibration detected from a toner recovery path of the image forming apparatus with predetermined reference vibration characteristics and determining whether the characteristics have reached the reference vibration characteristics;

outputting the result of the determination of whether the characteristics have reached the reference vibration characteristics, and determining indications that toner stagnates in the toner recovery path by determining whether the characteristics based on the detected vibration have reached the reference vibration characteristics, wherein the reference vibration characteristics are set in advance as indications representing that toner stagnates in the toner recovery path, wherein the outputting step further comprises outputting information representing indications that the toner stagnates in the toner recovery path as the result of the determination of whether the characteristics have reached the reference vibration characteristics, wherein the process further comprises detecting at least one of an initial vibration value and a vibration attenuation amount, and wherein the characteristics based on the vibration are an index value obtained by adding a count value representing the operating state of the image forming apparatus to at least one of the initial vibration value and the vibration attenuation amount.

7. A toner state determining method comprising:

comparing characteristics based on vibration detected from a toner recovery path of an image forming apparatus with predetermined reference vibration characteristics and determining whether the characteristics have reached the reference vibration characteristics;

outputting the result of the determination of whether the characteristics have reached the reference vibration characteristics, and determining indications that toner stagnates in the toner recovery path by determining whether the characteristics based on the detected vibration have reached the reference vibration characteristics, wherein the reference vibration characteristics are set in advance as indications representing that toner stagnates in the toner recovery path, wherein the outputting step further comprises outputting information representing indications that the toner stagnates in the toner recovery path as the result of the determination of whether the characteristics have reached the reference vibration characteristics, wherein the process further comprises detecting at least one of an initial vibration value and a vibration attenuation amount, and wherein the characteristics based on the vibration are an index value obtained by adding a count value representing the operating state of the image forming apparatus to at least one of the initial vibration value and the vibration attenuation amount.

* * * * *